US008205775B2

(12) United States Patent
Hogg

(10) Patent No.: US 8,205,775 B2
(45) Date of Patent: Jun. 26, 2012

(54) ADJUSTABLE HARNESS

(75) Inventor: Simon Christopher Hogg, Tyne & Wear (GB)

(73) Assignee: Draeger Safety UK Limited, Blyth, Northumberland (GB)

( * ) Notice: Subject to any disclaimer, the term of this patent is extended or adjusted under 35 U.S.C. 154(b) by 355 days.

(21) Appl. No.: 11/971,635

(22) Filed: Jan. 9, 2008

(65) Prior Publication Data

US 2008/0179366 A1 Jul. 31, 2008

(30) Foreign Application Priority Data

Jan. 31, 2007 (GB) ..... 0701861.7

(51) Int. Cl.
*A45F 3/00* (2006.01)

(52) U.S. Cl. ..... 224/634; 224/628; 224/632; 224/633

(58) Field of Classification Search ..... 224/148.2, 224/628, 631, 632, 633, 634, 934; 128/205.22; 405/186, 185, 187
See application file for complete search history.

(56) References Cited

U.S. PATENT DOCUMENTS 1,448,918 A 3/1923 Drager
2,362,643 A * 11/1944 Lambertsen ..... 128/205.12
2,764,151 A * 9/1956 Cupp ..... 128/202.22
2,854,001 A * 9/1958 Humblet ..... 128/202.22
5,022,790 A * 6/1991 Stevenson ..... 405/186
5,363,790 A 11/1994 Matsuoka
5,584,289 A * 12/1996 Wise ..... 128/205.24
6,478,510 B1 * 11/2002 Young ..... 405/186
2003/0116156 A1 * 6/2003 Jackson ..... 128/201.22
2004/0045991 A1 * 3/2004 Kling et al. ..... 224/628

OTHER PUBLICATIONS

Partial European Search Report for application No. 07124122.8-1258 dated Jun. 16, 2008.

* cited by examiner

*Primary Examiner* — Nathan J Newhouse
*Assistant Examiner* — Steven M Landolfi, Jr.
(74) *Attorney, Agent, or Firm* — DLA Piper LLP (US)

(57) ABSTRACT

An adjustable harness 10 for a self contained breathing apparatus, a back plate 12, a sliding plate 16, a pair of shoulder straps 20, 22 and a belt 18. The sliding plate 16 can move longitudinally with respect to the back plate between the extended position and the un-extended position. Shoulder straps 20, 22 are fixed to an upper portion of the sliding plate and a belt 18 is fixed to a lower portion of the back plate. A valve 28 is provided at the bottom of the back plate 12 so that a cylinder of breathable gas connected to the valve may be retained by a retaining strap 13. Hoses 24, 26 are attached to the sliding plate 16, cross over in the region of the opening 14 and as such the side of the sliding plate 16 to which they are attached is different to the side of the valve 28 from which they leave. Guide channels 34 are shaped to retain the hoses 24, 26. The hoses 24, 26 fold and unfold within the confines of the plates 12, 16 to prevent snagging.

12 Claims, 4 Drawing Sheets

ADJUSTABLE HARNESS

BACKGROUND OF THE INVENTION

The present invention relates to an adjustable harness for use with self-contained breathing apparatus (SBCA) having an improved body length adjusting system. More particularly, it relates to a body-length adjustable harness in which integration of the hoses and cables is improved; thus reducing the potential of snagging.

SCBA harnesses comprise a back plate, a pair of shoulder straps and a belt. The back plate is provided with a valve towards the lower end and a cylinder retaining strap. In use, a cylinder of breathable gas is attached to the valve and is secured to the back plate by means of the retaining strap. One or more flexible hoses extend from the valve to the shoulder straps so that breathing apparatus worn by the user may be conveniently connected thereto.

It is desirable for a SCBA harness to be adjustable in length. This allows it to be comfortably worn by users of different heights. There are known harnesses that have this feature. However, in previously considered harnesses, when the harness is adjusted from its maximum length to its minimum length there appears a surplus of hose. This means that the position of the hoses on the shoulder straps changes which may be inconvenient for the user. As an alternative, if the hoses remain fixed in place, a loop of hose protrudes from the harness. This creates a risk of snagging the hoses on obstacles whilst the harness is being worn. The hoses may either be damaged by snagging or may become entangled with an obstacle. This poses a safety risk to the wearer.

It is therefore desirable to provide a harness which is adjustable in length and in which the hoses remain fixed whilst not providing a snagging risk.

SUMMARY OF THE INVENTION

According to the invention there is provided a harness for use with breathing apparatus, comprising: a back plate for accommodating a gas cylinder; a sliding plate adjustable in a longitudinal direction with respect to the back plate so as to enable the length of the harness to be varied; at least one shoulder strap attached to an upper portion of the sliding plate; and at least one flexible conduit extending from a lower portion of the back plate, along the sliding plate, to at least one predetermined position on the shoulder strap; wherein retaining means or elements are provided on the sliding plate to prevent longitudinal movement of the flexible conduit with respect to the sliding plate, such that when the sliding plate is adjusted relative to the back plate the flexible conduit retains its predetermined position on the shoulder strap.

Preferably, during adjustment of the sliding plate relative to the back plate the flexible conduit is arranged to fold or unfold within the confines of the back plate.

In a preferred arrangement the harness comprises two shoulder straps. Each shoulder strap may have a conduit.

Preferably one or more guide channels are provided on the sliding plate for accommodating the one or more flexible conduits. The retaining means may be provided in the one or more guide channels. Further, the retaining means may comprise clamping elements provided in the one or more guide channels. The guide channels may be shaped to provide the retaining means.

Preferably at least one of said conduits extends on one side of the back plate from the lower portion of the back plate and passes through an opening in the back plate to the other side of the back plate before extending along the sliding plate.

Preferably two flexible conduits extend from the lower portion of the back plate and are configured to cross one another in the lateral direction of the back plate, so as to assist the folding and unfolding of the conduits when the sliding plate is moved.

The back plate may have biasing means or guide elements to help to bias or guide the folding and unfolding of each conduit. The biasing means or guide elements may include one or more grooves or projections provided on the back plate.

The flexible conduits may include a high-pressure hose and/or a medium-pressure hose.

The flexible conduits may include one or more electrical cables.

BRIEF DESCRIPTION OF THE DRAWING

An embodiment of the present invention will now be described, by way of example, with reference to the accompanying drawings, in which.

DESCRIPTION OF AN EMBODIMENT OF THE INVENTION

Figure 1:
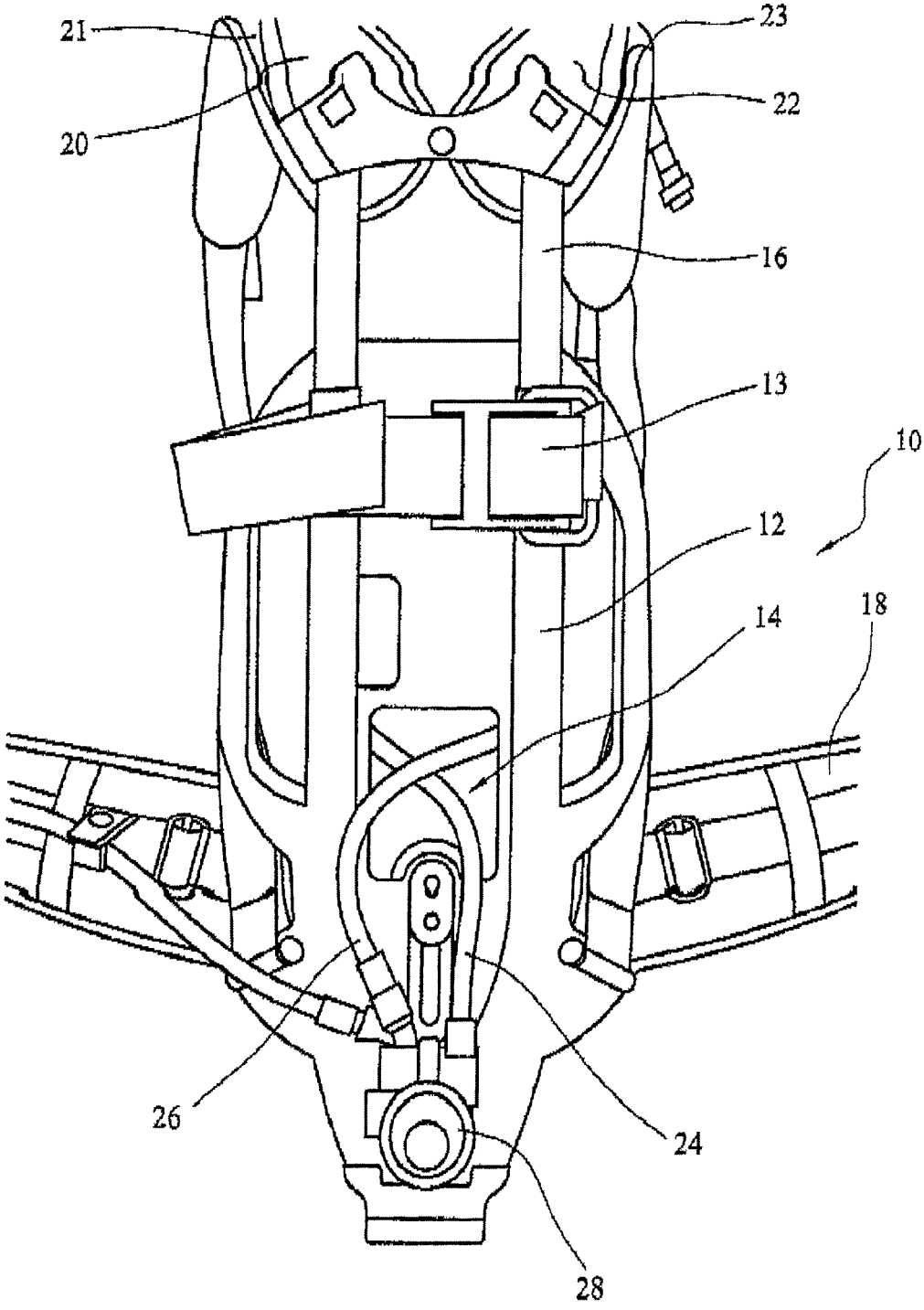
FIG. 1 shows a rear view of a harness according to an embodiment of the invention, wherein the harness is in an extended position.

Referring to FIG. 1 a harness 10 comprises a back plate 12, a sliding plate 16, a pair of shoulder straps 20, 22 and a belt 18. The sliding plate 16 is slidably attached to the back plate 12 in such a way that it can move longitudinally with respect to the back plate between the extended position shown in FIG. 1 and the un-extended position shown in FIG. 4. The shoulder straps 20, 22 are fixed to an upper portion of the sliding plate 16 and the belt 18 is fixed to a lower portion of the back plate 12. The sliding plate 16 can be fixed at various positions between the fully extended position and the un-extended position. This allows it to be adjusted so as to be comfortably worn by users of different heights. A valve 28 is provided at the bottom of the back plate 12. In use a cylinder of breathable gas is connected to the valve 28 and it is retained by the back plate 12 and a cylinder retaining strap 13. Two air supply hoses, or conduits, 24, 26 are connected to the valve 28 for supplying breathable gas, one to the breathing apparatus of the harness wearer and one to a pressure gauge. The hoses 24, 26 extend substantially longitudinally from the valve 28 and pass through an opening 14 in the back plate 12 to the inside of the back plate 12. In addition, or instead, one or more of the conduits may be an electrical cable.

Figure 2:
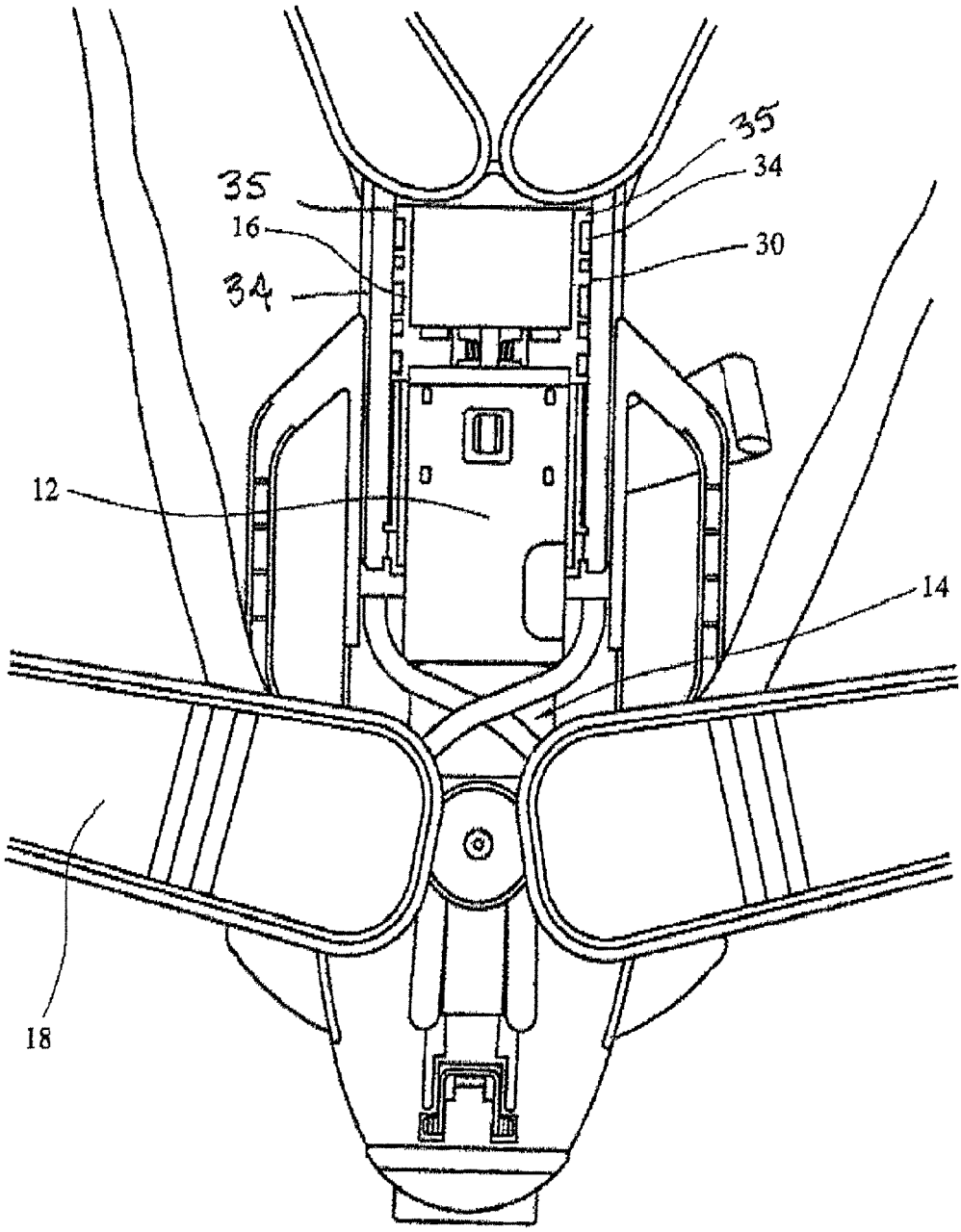
FIG. 2 shows an inside view of a harness according to an embodiment of the invention, wherein the harness is in an extended position.

Referring now to FIG. 2, the hoses 24, 26 are attached to the sliding plate 16, one being attached to each side. The hoses 24, 26 cross over in the region of the opening 14 and as such the side of the sliding plate 16 to which they are attached is different from the side of the valve 28 from which they leave. There is a longitudinally extending guide channel 34 for retaining hoses on each side of the sliding plate 16. The guide channels 34 are shaped with projections 35 within and along their length so as to retain the hoses 24, 26 within them. The hoses 24, 26 extend along substantially the full length of the sliding plate 16 and exit or leave the sliding plate in the region of the shoulder straps 20, 22.

Figure 3:
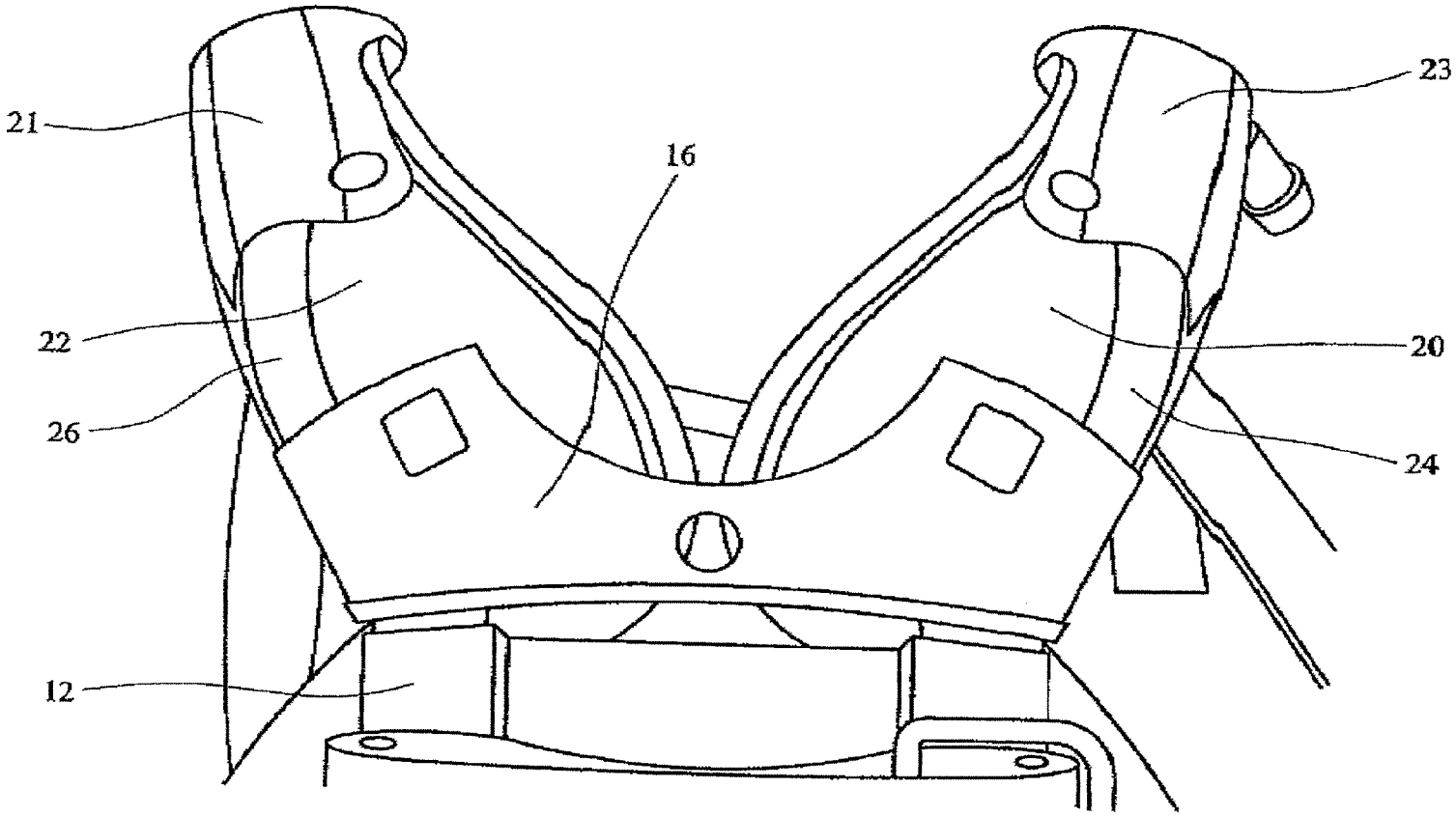
FIG. 3 shows the shoulder straps according to an embodiment of the invention.

As can be seen in FIG. 3, the hoses 24, 26 are attached to the upper side of each shoulder strap 20, 22 and are held in place and protected by sleeves 21, 23. The hoses 24, 26 are fixed to the shoulder straps 20, 22 and have connectors at their ends that are suitable for connection to breathing apparatus.

Figure 4:
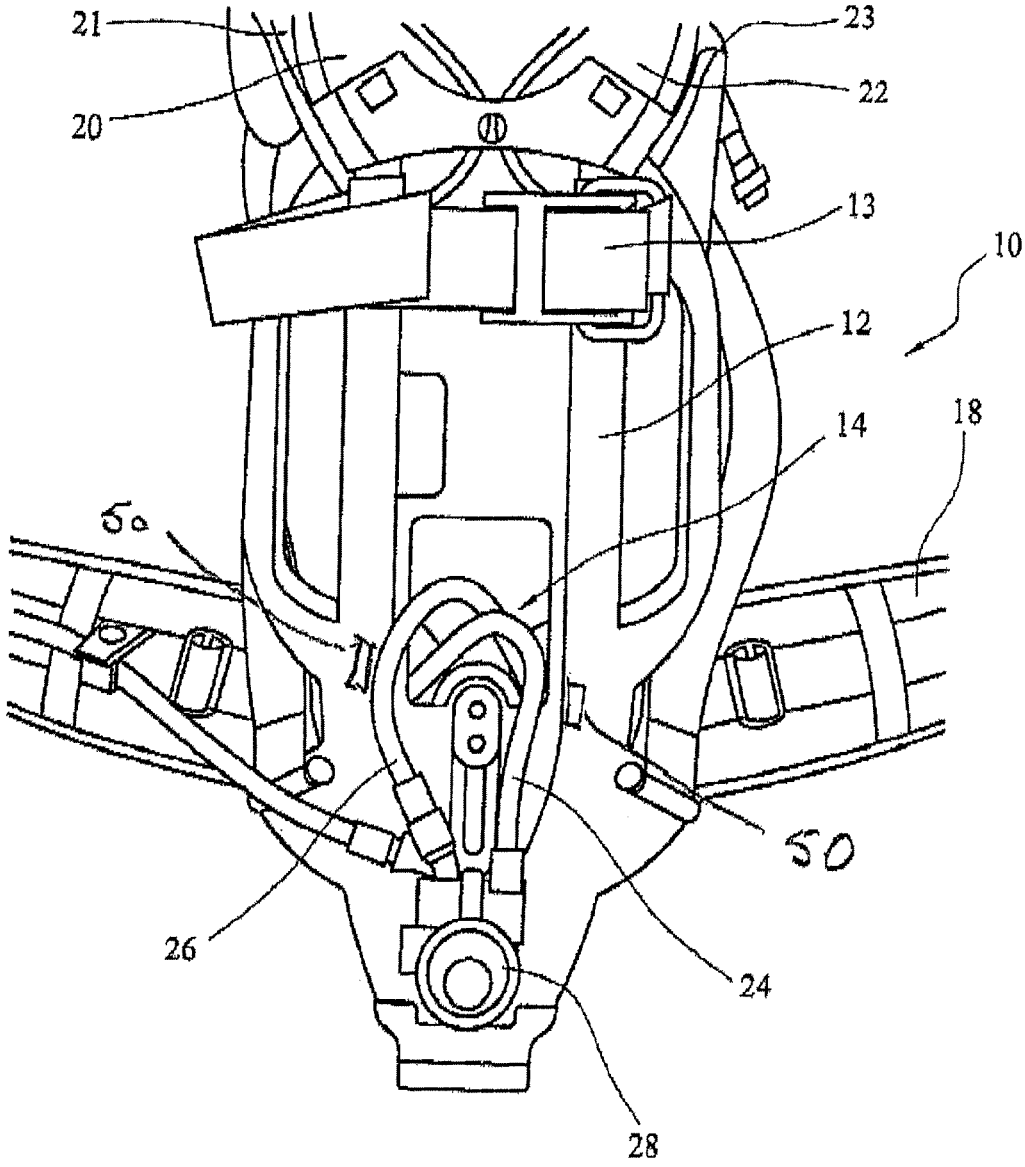
FIG. 4 shows a rear view of a harness according to an embodiment of the invention, wherein the harness is in an un-extended position.

When the sliding plate 16 is moved to the non-extended position, shown in FIG. 4, the hoses 24, 26 remain in the predetermined positions relative to the shoulder straps 20, 22. Due to the configuration of the back plate 12 and the positional mounting of the hoses 24, 26 with respect to the valve 28 and the sliding plate 16 the hoses 24, 26 fold within the region of the opening 14 of the back plate 12. Since the excess lengths of hoses 24, 26 are accommodated within the confines of the back plate 12 there is no risk of snagging the hoses 24, 26 on obstacles.

To aid in the folding of the hoses 24, 26 there may be elements or projections 50 provided on the rear of the back plate 12 that bias or guide the hoses 24, 26 to fold in a particularly desired manner.

Extending or telescoping sliding place 16 relative to back plate 12 causes the hoses 24, 26 to unfold to the extent necessary from the position shown in FIG. 4 to a position shown for example in FIG. 1. Thus, hoses 24, 26 fold or unfold in response to relative movement of sliding plate 16 with respect to back plate 12 in a controlled position.

While an embodiment of the invention has been described, the invention is limited only by the following Claims and equivalents thereof.

The invention claimed is:

1. A harness for use with breathing apparatus, comprising:

a back plate for accommodating a gas cylinder;

a sliding plate adjustable in a longitudinal direction with respect to the back plate so as to enable the length of the harness to be varied;

at least two shoulder straps attached to an upper portion of the sliding plate;

at least two flexible conduits, at least one of which extends from a lower portion of the back plate along the sliding plate, to at least one predetermined position on one of the at least two shoulder straps; and a first guide channel disposed on a first side of the sliding plate and a second guide channel, separated and distinct from the first guide channel, disposed on a second opposing side of the sliding plate, each of the first and second guide channels adapted to retain a separate flexible conduit; wherein retaining means are provided on the sliding plate to prevent longitudinal movement of the flexible conduits with respect to the sliding plate, such that when the sliding plate is adjusted relative to the back plate the flexible conduits retain their predetermined position on the shoulder straps;

wherein the at least two flexible conduits cross one another in the lateral direction of the back plate, so as to assist the folding and unfolding of the conduits when the sliding plate is moved.

2. A harness according to claim 1, wherein the at least two flexible conduits are arranged to fold or unfold within the confines of the back plate.

3. A harness according to claim 1, wherein each of the at least two shoulder straps has a conduit.

4. A harness according to claim 1, wherein the retaining means are provided in at least one of the first and second guide channels.

5. A harness according to claim 1, wherein the retaining means comprises clamping elements provided in at least one of the first and second guide channels.

6. A harness according to claim 1, wherein one of the first and second guide channels are shaped to provide the retaining means.

7. A harness according to claim 1, wherein at least one of said at least two flexible conduits extends on one side of the back plate from the lower portion of the back plate and passes through an opening in the back plate to the other side of the back plate before extending along the sliding plate.

8. A harness according to claim 1, wherein the at least two flexible conduits comprise a high-pressure hose and a medium-pressure hose.

9. A harness according to claim 1, wherein the at least two flexible conduits comprise one or more electrical cables.

10. A harness according to claim 1, wherein the back plate includes a guide element to augment the folding and unfolding of each of the at least two flexible conduits.

11. A harness according to claim 10, wherein the guide element includes at least one projection provided on the back plate.

12. A harness for use with breathing apparatus, comprising:

a back plate for accommodating a gas cylinder, the back plate having an opening in a lower region thereof;

a sliding plate adjustable in a longitudinal direction with respect to the back plate so as to enable the length of the harness to be varied;

at least two shoulder straps attached to an upper portion of the sliding plate;

a valve provided at the bottom of the back plate on a first face;

a left guide channel disposed on the left side of a second face of the sliding plate and a right guide channel, separated and distinct from the left guide channel, disposed on a the right side of a second face of the sliding plate, each guide channel adapted to retain a separate flexible conduit;

first and second flexible conduits extending from left and right sides of the valve respectively and which pass through the opening in the back plate to a second face of the back plate, and right and left retaining means provided for retaining the first and second flexible conduits in the right and left guide channels respectively so as to prevent longitudinal movement of the flexible conduits with respect to the sliding plate, such that when the sliding plate is adjusted relative to the back plate the flexible conduits retain their predetermined position on the shoulder straps, wherein the first and second flexible conduits are adapted to cross one another in the lateral direction of the back plate in the region of the opening, wherein a first flexible conduit is retained in the right guide channel and a second flexible conduit is retained in the left guide channel, wherein at least one of the first and second flexible conduits extends from a lower portion of the back plate along the sliding plate, to at least one predetermined position on one of the at least two shoulder straps, and wherein the positioning of the first and second flexible conduits and the right and left guide channels are configured such that when the sliding plate is moved from a first extended position to a second non-extended position the conduits fold within the region of the opening in the back plate.

* * * * *